United States Patent [19]

Ortloff

[11] Patent Number: 4,493,282

[45] Date of Patent: Jan. 15, 1985

[54] COMBINATION MOORING SYSTEM

[75] Inventor: John E. Ortloff, Houston, Tex.

[73] Assignee: Exxon Production Research Co., Houston, Tex.

[21] Appl. No.: 476,677

[22] Filed: Mar. 18, 1983

[51] Int. Cl.[3] ..... B63B 21/00; B63B 21/52

[52] U.S. Cl. ..... 114/230; 441/3

[58] Field of Search ..... 114/230, 250; 441/3–5; 141/387, 388

[56] References Cited

U.S. PATENT DOCUMENTS

| | | | |
|---|---|---|---|
| 3,430,597 | 3/1969 | Zunderdorp | 114/230 |
| 3,712,260 | 1/1973 | Mott et al. | 114/230 |
| 3,865,066 | 2/1975 | White et al. | 14/230 |
| 4,130,076 | 12/1978 | Bilderbeek | 114/230 |
| 4,133,283 | 1/1979 | Ryan | 114/230 |
| 4,266,499 | 5/1981 | Tam | 114/230 |
| 4,299,261 | 11/1981 | Talafuse | 141/387 |
| 4,315,533 | 2/1982 | Eagles | 141/387 |
| 4,317,421 | 3/1982 | Pollack | 114/230 |

FOREIGN PATENT DOCUMENTS

| | | | |
|---|---|---|---|
| 2019800 | 11/1979 | United Kingdom | 441/5 |

*Primary Examiner*—Sherman D. Basinger

*Attorney, Agent, or Firm*—Alan J. Atkinson

[57] ABSTRACT

A combination mooring system for mooring a floating vessel to an offshore structure is disclosed. When a loading force induced by wind, waves, ice, or ocean currents does not act against the vessel, the mooring system is at a mean position. As a loading force urges the vessel away from the structure, the mooring system adapts to accommodate movement of the vessel relative to the structure. To counteract movement of the mooring system from its mean position, a buoy connected by a cable to the mooring system is progressively submerged. As the buoy is submerged, it provides a buoyant restoring force which counteracts the loading force acting on the vessel. When the loading force subsides, the buoyant restoring force urges the mooring system toward its mean position. In a preferred embodiment, the mooring system has a stop which limits the excursion of the mooring system from its mean position. Therefore, if the displacing force should exceed the buoyant restoring force, the stop will convert the adaptable mooring system to a rigid mooring system capable of handling extreme loading forces.

15 Claims, 6 Drawing Figures

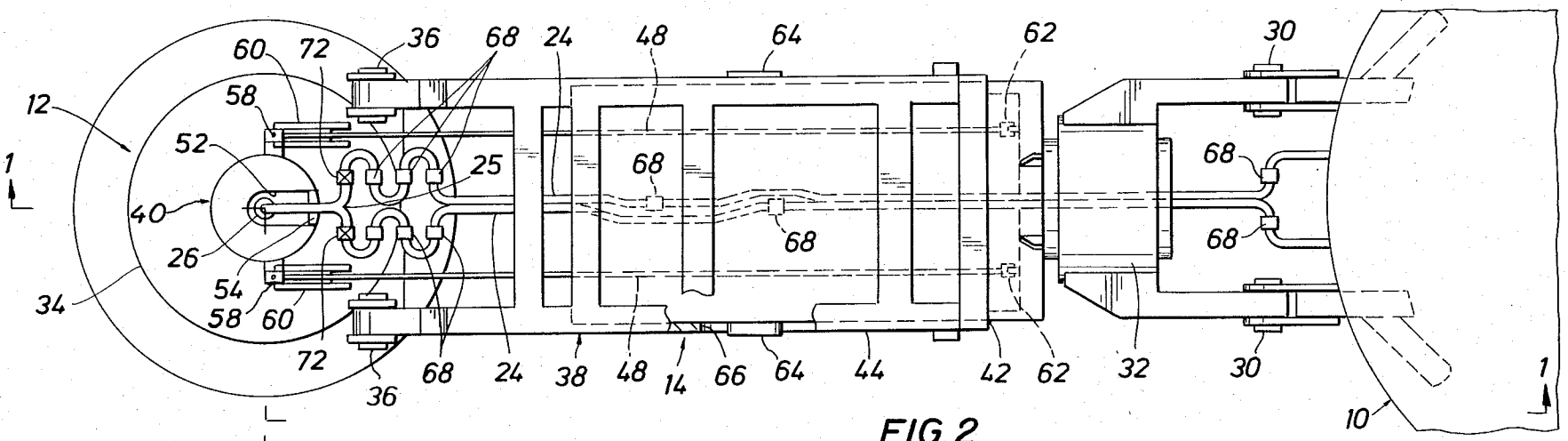
FIG. 2
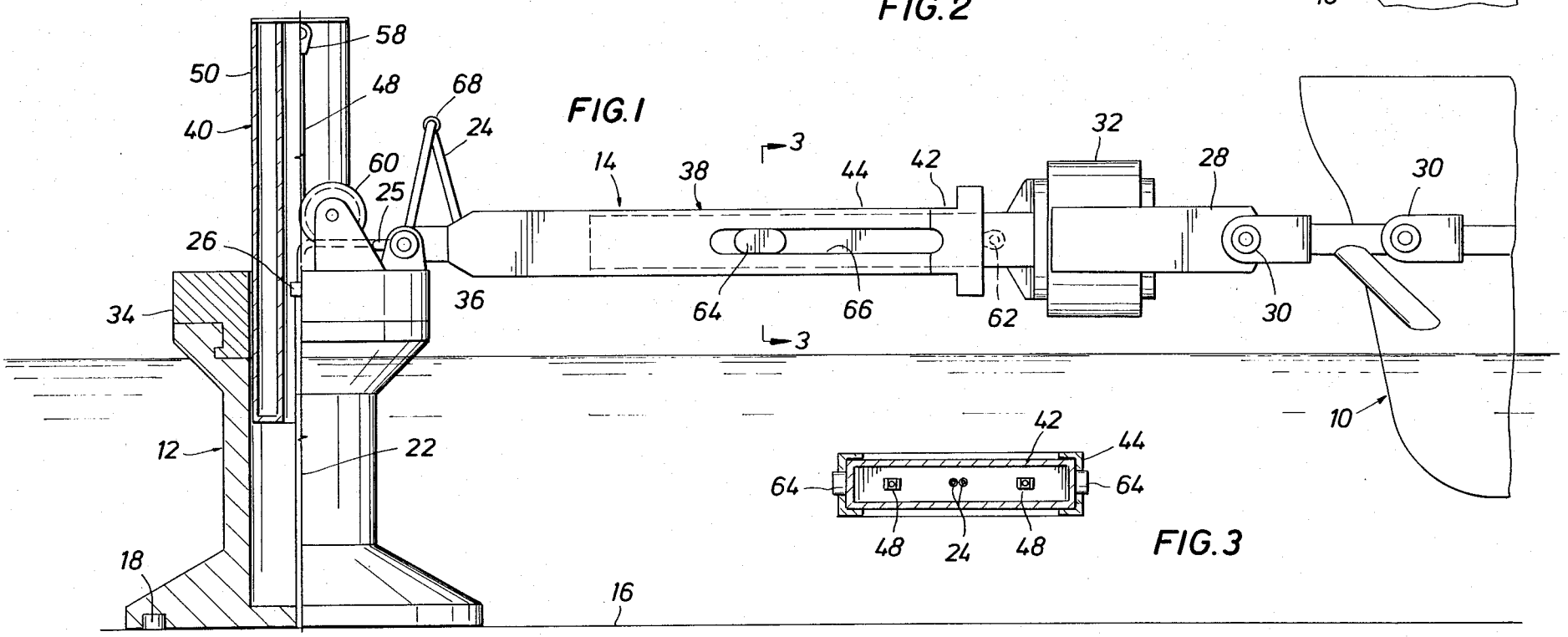
FIG. 1
FIG. 3

COMBINATION MOORING SYSTEM

1. FIELD OF THE INVENTION

The present invention relates to an apparatus for mooring a vessel to a fixed structure. More particularly, the present invention relates to a buoy in a mooring apparatus for counteracting movement of a vessel due to loading forces induced by wind, waves, ice, and ocean currents.

2. BACKGROUND OF THE INVENTION

In the offshore production of oil, gas, and other production fluids, floating vessels are frequently used to transport the production fluids to onshore consuming markets. The production fluids are produced from an offshore structure which is firmly anchored to the sea floor with pilings. To convey production fluids from a subsea well to the water surface, the offshore structure supports a fluid-carrying system called a riser. A flowline connected to the upper end of the riser conveys the production fluids to a storage tanker which may be permanently moored to the offshore structure. Shuttle tankers offload the production fluids from the storage tanker for transportation to an onshore market.

In a water environment, a mooring system must be sufficiently flexible to accommodate movement of the vessel relative to the offshore structure. As the vessel is acted upon by loading forces induced by wind, waves, ice, and ocean currents, the vessel will roll, pitch and heave. In addition, the vessel will yaw about its mooring point as the direction of the loading forces vary. As the vessel moves, it will impart dynamic forces which tend to damage a rigid mooring structure and the attached offshore structure. Therefore, a rigid mooring system is undesirable in a water environment because it is unable to accommodate relative movement between the vessel and the offshore structure.

To provide a flexible mooring system in a water environment, nylon hawsers are used to moor a vessel to an offshore structure. Because nylon is an elastic material, nylon hawsers dampen the dynamic forces which are induced by movement of the vessel.

Although nylon hawsers are sufficiently strong to moor a storage vessel to an offshore structure in a water environment, nylon hawsers cannot safely be used in a cryogenic environment such as the Artic. During the Artic winter, nylon loses its resiliency and becomes brittle. This brittleness reduces the breaking strength of a nylon hawser which may lead to failure of the hawser. Weakened nylon hawsers are particularly susceptible to failure as moving pack ice acts against a moored storage vessel. Moving pack ice containing ice ridges up to thirty feet in height will exert enormous forces against a moored vessel.

Although nylon hawsers cannot safely moor a storage vessel throughout the year in an Artic environment, rigid mooring chains are sufficiently strong to withstand the forces induced by moving pack ice. However, rigid mooring chains are not suitable in a water environment because they are not sufficiently elastic to accommodate movement of the storage vessel. As the vessel moves toward the structure, the mooring chains can become slack. If loading forces urge the vessel away from the structure, the vessel can gain sufficient momentum to impart a large impact force to the mooring chains and connected structure when the vessel reaches the excursion length of the chains. In such event, the structure or chains may be damaged.

While nylon hawsers can moor a vessel in a water environment and rigid mooring chains can be substituted for nylon hawsers during the winter months, valuable production time will be lost when the fluid-carrying system is shut down to convert from nylon hawsers to the mooring chains. There is, therefore, a need for a mooring system that can accommodate loading forces acting on a vessel due to wind, waves, ice, or ocean currents. Further, there is a need for a mooring system that can be used in a water environment and in an ice bound environment.

SUMMARY OF THE INVENTION

The present invention provides an apparatus for mooring a floating vessel acted upon by a loading force induced by wind, waves, ice or ocean currents. The apparatus includes a mooring means connected between the vessel and a base. The mooring means has a mean position when the vessel is not acted upon by a loading force. As a loading force moves the vessel relative to the base, the mooring means is displaceable from its mean position to accommodate such movement.

As a loading force acts on the vessel to urge the mooring means from its mean position, a buoy means connected to the mooring means is progressively submerged to provide a buoyant restoring force which counteracts the loading force. When the buoyant restoring force equals the loading force, the mooring means will be at equilibrium. As the loading force subsides, the buoy means will urge the mooring means toward its mean position.

In a preferred embodiment of the present invention, the mooring means includes stop means for limiting the excursion of the mooring means from its mean position. If the loading force should exceed the buoyant restoring force provided by the buoy means, the stop means will convert the flexible mooring means to a rigid mooring means.

BRIEF DESCRIPTION OF THE DRAWINGS

FIG. 1 illustrates in partial section an elevational view of a vessel connected to an offshore structure by a combination mooring system.

FIG. 2 illustrates in partial section a plan view of the mooring system.

FIG. 3 illustrates a sectional view taken along line 3—3 showing the first mooring arm and the second mooring arm.

DESCRIPTION OF THE PREFERRED EMBODIMENTS

Figure 4:
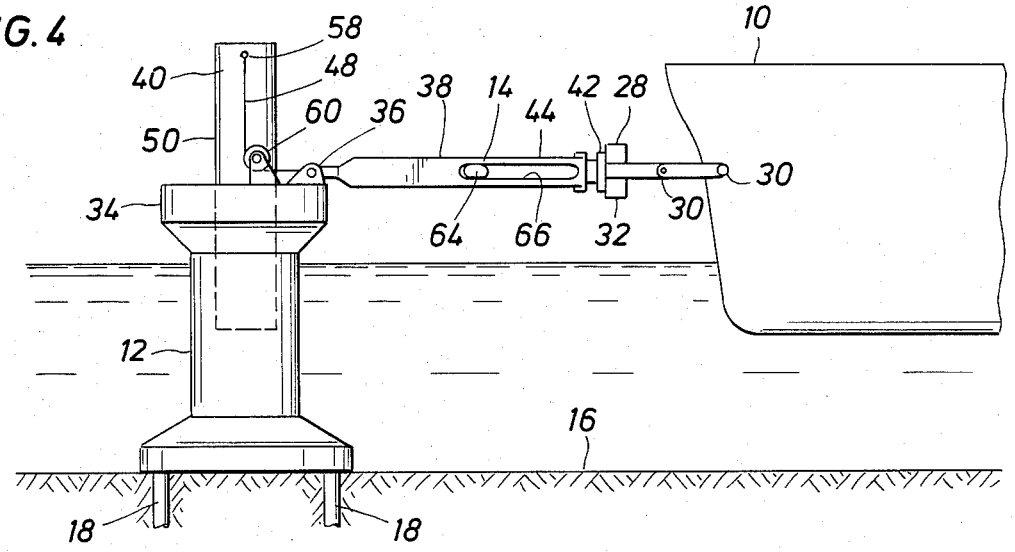
FIG. 4 illustrates an elevational view of the mooring system at its mean position.

FIG. 1 illustrates storage vessel 10 which is connected to bottom founded base or offshore structure 12 by means of mooring system 14. Structure 12 is anchored to sea floor 16 with piles 18 which handle dynamic vertical loading of structure 12 due to wave action or ice forces acting on structure 12. Static uplift of structure 12 is withstood by the weight of structure 12 and piles 18. Structure 12 supports riser 22 which conveys production fluids from subsea wells (not shown) to the water surface. Flowlines or other conduits 24 merge at tee 25 and are connected by axial swivel 26 to the upper end of riser 22 for conveying the production fluids to vessel 10. The production fluids may then be offloaded to shuttle tankers (not shown).

In a water environment, vessel 10 is subject to loading forces induced by wind, waves and ocean currents. These loading forces cause vessel 10 to pitch, roll, and yaw about its mooring point. To accommodate pitch and roll of vessel 10, mooring system 14 is connected by yoke 28 to vessel 10. Yoke 28 includes hinges 30 which provide an articulated connection between mooring system 14 and vessel 10 to accommodate pitch of vessel 10. Yoke 28 also includes roll shaft 32 to accommodate roll of vessel 10 about its longitudinal axis.

As the direction of the loading forces changes, vessel 10 will yaw about its mooring point and tend to rotate about the vertical axis of structure 12. To accommodate such rotation, the upper end of structure 12 includes a turntable or mooring swivel 34 which rotates independently of structure 12. Mooring swivel 34, connected to mooring system 14, permits vessel 10 to weathervane about structure 12 as the direction of the loading forces change. Mooring system 14 may be connected to mooring swivel 34 by hinge 36 to permit rotation of mooring system 14 about a horizontal axis perpendicular to mooring system 14.

As vessel 10 weathervanes about structure 12, the loading forces will tend to urge vessel 10 away from structure 12. As previously discussed, neither nylon hawsers nor rigid mooring chains can adequately moor a vessel in an Artic environment which may include open water and moving pack ice. Nylon hawsers are not strong enough to moor a vessel acted upon by moving pack ice. Moreover, neither nylon hawsers nor rigid mooring chains will prevent collision between the vessel and the mooring structure if the loading forces should change too suddenly for the vessel to weathervane about the structure. While rigid mooring chains are sufficiently strong to accommodate loading forces induced by moving ice, the rigid chain will transfer to structure 12 impact forces induced by movement of vessel 10. The present invention overcomes the shortcomings of nylon hawsers and rigid mooring chains by providing an apparatus that can moor a vessel in a changing Artic environment.

To prevent the movement of vessel 10 from damaging structure 12 in a water environment, the present invention provides mooring system 14 which flexes to accommodate movement of vessel 10 about structure 12. Mooring system 14 generally includes mooring means 38 and restoring means 40. Referring to FIG. 2, mooring means 38 includes first mooring arm 42 and second mooring arm 44. An end of first mooring arm 42 is connected to yoke 28 with hinge 30, and an end of second mooring arm 44 is connected to mooring swivel 34 with hinge 36. The other, free end of first mooring arm 42 is in sliding engagement with the other, free end of second mooring arm 44 to accommodate relative movement between vessel 10 and structure 12. Self-lubricating Merriman TM bearings can be used to lessen friction between this sliding engagement of first mooring arm 42 and second mooring arm 44.

First mooring arm 42 is initially at a mean position with respect to second mooring arm 44 when there are no loading forces acting on vessel 10. As loading forces urge vessel 10 away from structure 12, first mooring arm 42 is displaced from the mean position as it telescopes within second mooring arm 44 to accommodate movement of vessel 10. To urge first mooring arm 42 toward the mean position, restoring means 40 furnishes a restoring force on first mooring arm 42 which counteracts the loading forces acting on vessel 10.

Referring to FIG. 1, restoring means 40 includes cable 48 and buoy 50. Buoy 50 is illustrated as generally cylindrical in shape and disposed within structure 12 such that its vertical centerline corresponds with the vertical axis of mooring swivel 34. To ensure that buoy 50 rotates in conjunction with mooring swivel 34 as vessel 10 weathervanes about structure 12, buoy 50 includes slotted keyway 52 for receiving key 54 which is attached to mooring swivel 34. The upper end of buoy 50 is connected to a first end of cable 48 with coupling 58. Cable 48 is reeved about sheave 60 which is attached to mooring swivel 34. The second end of cable 48 is connected with coupling 62 to the free end of first mooring arm 42.

Figure 5:
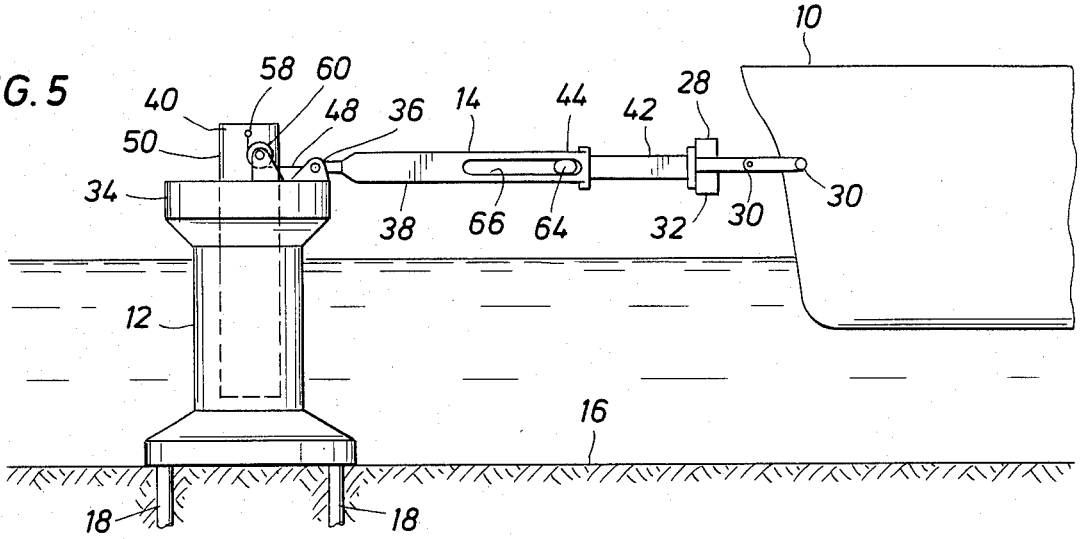
FIG. 5 illustrates an elevational view of the mooring system at an equilibrium position as a constant loading force urges the vessel away from the offshore structure.

Referring to FIG. 4, when mooring system 14 is in its mean position, buoy 50 floats in the water and does not exert any force on cable 48. Due to its weight, buoy 50 will be partially submerged. As loading forces urge vessel 10 away from structure 12 and first mooring arm 42 correspondingly telescopes within second mooring arm 44, first mooring arm 42 exerts a displacing force on cable 48 which tends to progressively submerge buoy 50. As buoy 50 is submerged, it exerts a buoyant restoring force against cable 48 which can be determined by equations well-known in the art. When the buoyant restoring force exerted on cable 48 is equivalent to the displacing force exerted by the loading forces acting on vessel 10, the mooring system will be in an equilibrium position illustrated in FIG. 5. If the loading forces acting on vessel 10 subside, the buoyant restoring force exerted by partially submerged buoy 50 will urge vessel 10 toward structure 12 until mooring system 14 is at the mean position.

Because the displacing force exerted by the loading forces acting on vessel 10 may exceed the maximum buoyant restoring force exerted by buoy 50, first mooring arm 42 includes stop 64. Referring to FIG. 1, stop 64 travels within slot 66 in second mooring arm 44 as first mooring arm 42 telescopes within second mooring arm 44. When the displacing force exceeds the buoyant restoring force, stop 64 contacts a first end of slot 66 and limits the excursion of first mooring arm 42 away from structure 12. When stop 64 contacts the first end of slot 66, mooring system 14 becomes a rigid system which can accommodate extreme loading forces on vessel 10 such as those forces imposed by moving pack ice. When the extreme loading forces are removed, as occurs during the spring breakup of pack ice, mooring system 14 automatically converts to a flexible system capable of handling vessel movement in a water environment.

While the first end of slot 66 limits the maximum excursion of vessel 10 away from structure 12, stop 64 will contact the second end of slot 66 if a sudden directional change in the loading forces should urge vessel 10 toward structure 12 before vessel 10 can weathervane about structure 12. In such event, contact between stop 64 and the second end of slot 66 will prevent accidental collision between vessel 10 and structure 12. Nylon hawsers and mooring chains cannot prevent any such collision.

To transport production fluids from sea floor 16 to the water surface, riser 22 may be located in keyway 52 of buoy 50. Although only one riser and two flowlines are illustrated, the present invention can be configured to accommodate multiple risers and flowlines through use of a multiline swivel such as that disclosed in U.S. Pat. No. 4,126,336. To transport production fluids from structure 12 to vessel 10, flowlines 24 may include appropriate in-line swivels 68 to handle relative movement between vessel 10 and structure 12. The two flowlines 24 illustrated in FIG. 2 provide redundancy and permit maintenance operations to be performed without stopping the flow of production fluids from riser 22 to vessel 10. Valves 72 are located so that flow of the production fluids through flowlines 24 can be controlled.

Figure 6:
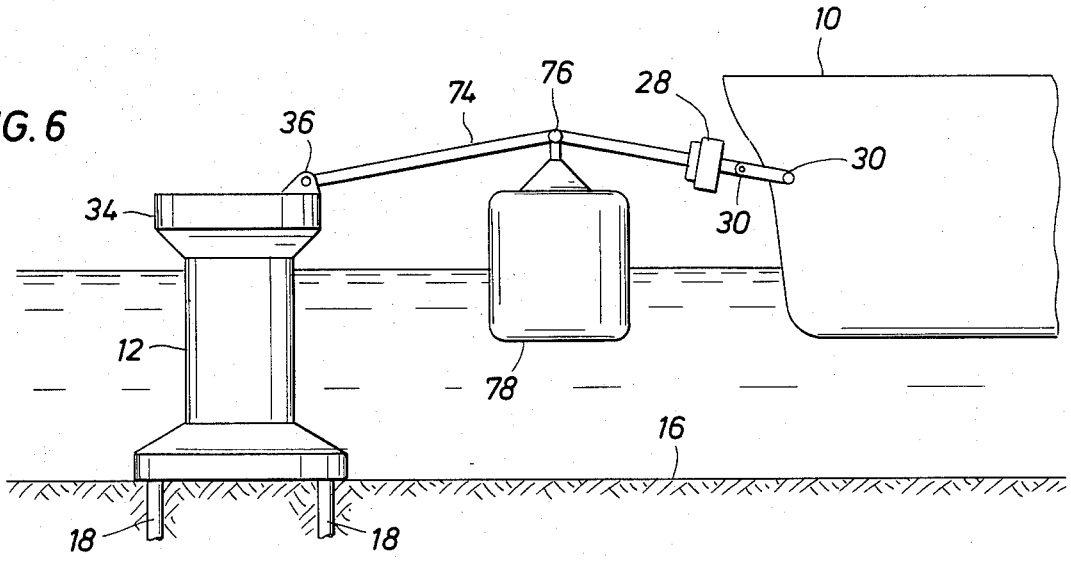
FIG. 6 illustrates an elevational view of an alternative embodiment of the invention wherein the buoy is connected to the mooring system but is not connected to the offshore structure or the vessel.

FIG. 6 illustrates an alternative embodiment of the present invention which includes mooring system 74 to connect vessel 10 and structure 12 at hinge points 30 and 36 respectively. As illustrated, mooring system 74 is articulated at hinge 76 to accommodate relative movement between vessel 10 and structure 12. In the absence of a displacing force, mooring system 74 will be at its mean position. Buoy 78 is connected to mooring system 74 to provide a buoyant restoring force which counteracts displacement of mooring system 74 from its mean position.

As loading forces urge vessel 10 away from structure 12, the displacing force exerted by vessel 10 on mooring system 74 progressively submerges buoy 78 until the buoyant restoring force exerted by buoy 78 equals the vertical component of the displacing force. If the displacing force is sufficiently great, it will pull mooring system 74 into a straightened position. In such event, the vertical component of the displacing force will disappear and mooring system 74 will act as a rigid member capable of handling an extreme displacing force. If the displacing force subsides, buoy 78 will urge mooring system 74 toward its mean position.

The foregoing example illustrates one of the many embodiments of the present invention. The buoy can be located in various positions relative to the mooring means to accomplish the objectives of the invention. For example, the buoy can be attached to structure 12, vessel 10, or to mooring means as shown in FIG. 6. The size of the buoy can be varied by one skilled in the art to handle the particular loading forces expected in a given application. The configuration of the buoy can likewise be varied to control the response of the mooring system in counteracting a loading force. It will be appreciated that configuration of the mooring means and mechanical linkages connecting the buoy to the mooring means may be adapted to a wide variety of applications.

The present invention provides a novel and unobvious apparatus which uses a buoy providing a buoyant restoring force to counteract a displacing force induced by loading forces acting on a vessel. Although the displacing force will change in response to varying loading forces, submersion of the buoy automatically provides a buoyant restoring force to offset the displacing force at any time. The invention also provides the unique capability of automatically converting a flexible mooring system into a rigid mooring system capable of handling extreme loading forces which act on a moored vessel.

What is claimed is:

1. An apparatus for mooring a floating vessel which is acted upon by a loading force induced by wind, waves, ice, or an ocean current, comprising:

a base;

mooring means connected between the vessel and said base and generally being located above the water surface, said mooring means having a mean position when the vessel is not acted upon by the loading force and being displaceable from its mean position to accommodate movement, induced by the loading force, of the vessel relative to said base;

buoy means partially located within said base and connected to said mooring means, said buoy means capable of being submerged, as said mooring means is displaced from its mean position by the loading force, to provide a buoyant restoring force for urging said mooring means toward its mean position; and stop means attacted to said mooring means for limiting the excursion of said mooring means from its mean position.

2. An apparatus as recited in claim 1, wherein said base is rotatable to permit weathervaning of the vessel about said base.

3. An apparatus as recited in claim 1, further comprising a conduit means for conveying a fluid between said base and the vessel.

4. An apparatus as recited in claim 1 wherein said buoy means is attached to said base.

5. An apparatus as recited in claim 1, wherein said buoy means provides the buoyant restoring force for urging said mooring means toward its mean position as the loading force urges the vessel away from said base.

6. An apparatus for mooring a floating vessel which is acted upon by a loading force induced by wind, waves, ice, or an ocean current, comprising:

a base;

mooring means connected between the vessel and said base and generally being located above the water surface, said mooring means having a mean position when the vessel is not acted upon by the loading force and being displaceable from its mean position to accommodate movement, induced by the loading force, of the vessel relative to said base;

a cable member having a first end and a second end, wherein said first end of the cable member is connected to said mooring means; and buoy means connected to said second end of the cable member and slidable within said base, said buoy means capable of being submerged, as said mooring means is displaced from its mean position by the loading force, to provide a buoyant restoring force for urging said mooring means toward its mean position.

7. An apparatus as recited in claim 6, wherein said mooring means includes stop means for limiting the excursion of said mooring means from its mean position.

8. An apparatus as recited in claim 6, wherein said base is rotatable to permit weathervaning of the vessel about said base.

9. An apparatus as recited in claim 6, wherein said buoy means is rotatable with said base so that the angular position of said buoy means relative to said base is substantially fixed.

10. An apparatus as recited in claim 6, further comprising a conduit means for conveying a fluid between said base and the vessel.

11. An apparatus for mooring a floating vessel which is acted upon by a loading force induced by wind, waves, ice, or an ocean current, comprising:

a base;

a first mooring arm connected to the vessel;

a second mooring arm connected to said base such that said second mooring arm is in sliding engagement with said first mooring arm to permit movement between said vessel and said base, said first mooring arm having a mean position relative to said second mooring arm when the vessel is not acted upon by the loading force; and buoy means attached to said base and connected to said first mooring arm so that as said first mooring arm is displaced from its mean position relative to said second mooring arm by said loading force, said buoy means will be progressively submerged to provide a buoyant restoring force for urging said first mooring arm towards its mean position.

12. An apparatus as recited in claim 11, wherein said base is rotatable to permit weathervaning of the vessel about said base.

13. An apparatus as recited in claim 11, further comprising a conduit means for conveying a fluid between said base and the vessel.

14. An apparatus as recited in claim 11, further comprising stop means for limiting the excursion of said first mooring arm from its mean position relative to said second mooring arm.

15. A method for mooring a floating vessel which is acted upon by a loading force induced by wind, waves, ice, or an ocean current, comprising the steps of:

connecting the vessel to a base with a mooring means which is generally located above the water surface, said mooring means having a mean position when the vessel is not acted upon by the loading force and being displaceable from its mean position to accommodate movement, induced by the loading force, of the vessel relative to said base; and exerting a buoyant restoring force which counteracts movement of said mooring means from its mean position by progressively submerging a buoy means partially located within said base and connected to said mooring means until the buoyant restoring force exerted by said buoy means equals the loading force acting upon the vessel.

* * * * *